US006902367B2

(12) United States Patent
Hataya

(10) Patent No.: US 6,902,367 B2
(45) Date of Patent: Jun. 7, 2005

(54) BINDING MACHINE WITH TAPE

(76) Inventor: Hiroshi Hataya, c/o Taiyo Seiki Co., Ltd., 3-7, Hino 4-chome, Daito-shi, Osaka 574-0062 (JP)

( * ) Notice: Subject to any disclaimer, the term of this patent is extended or adjusted under 35 U.S.C. 154(b) by 311 days.

(21) Appl. No.: 10/176,651

(22) Filed: Jun. 24, 2002

(65) Prior Publication Data

US 2003/0007847 A1 Jan. 9, 2003

(30) Foreign Application Priority Data

Jul. 6, 2001 (JP) ..... 2001-206693

(51) Int. Cl.[7] ..... B42B 5/04
(52) U.S. Cl. ..... 412/36; 412/9; 412/902
(58) Field of Search ..... 412/9, 36, 37, 412/902

(56) References Cited

U.S. PATENT DOCUMENTS 5,039,268 A * 8/1991 Blatia et al. ..... 412/37
5,054,417 A * 10/1991 Bhatia et al. ..... 118/242
6,233,910 B1 * 5/2001 Hataya ..... 53/589
2003/0007847 A1 * 1/2003 Hataya ..... 412/36

FOREIGN PATENT DOCUMENTS

| | | | |
|---|---|---|---|
| EP | 1035020 | * | 9/2000 |
| EP | 1035020 A1 | | 9/2002 |
| EP | 1273521 | * | 1/2003 |
| JP | 61-178810 | | 8/1986 |
| JP | 01-153350 | | 10/1989 |
| JP | 06278709 | * | 10/1994 |
| JP | 08133220 | | 5/1996 |
| JP | 2000-033910 | | 2/2000 |

OTHER PUBLICATIONS

Notification of Reason(s) for Refusal.

* cited by examiner

*Primary Examiner*—Monica S. Carter
(74) *Attorney, Agent, or Firm*—Rabin & Berdo, P.C.

(57) ABSTRACT

A binding machine with a tape enlarges a loop formed at an end of a tape to a predetermined size by the travel of the tape. The loop enlarged to the predetermined size is contracted, to bind a material to be bound in the loop. The binding machine comprises nick formation means for forming a nick for inducing fracture at a side edge of the tape having the loop enlarged to the predetermined size.

9 Claims, 6 Drawing Sheets

BINDING MACHINE WITH TAPE

CROSS REFERENCE TO RELATED APPLICATION

This application claims priority benefits under 35 USC § 119 of Japanese Patent Application Serial No. 2001-206693, the disclosure of which is incorporated by reference.

BACKGROUND OF THE INVENTION

1. Field of the Invention

The present invention relates to a binding machine with a tape, in which a loop is formed by the tape, and the loop is tightened, to bind a material to be bound.

2. Description of Related Arts

Conventionally provided as a small-sized binding machine for binding bills or the like is one for winding a binding tape. At least one surface of the binding tape has thermal adhesive properties. The binding tape is wound around a material to be bound, and an outer surface of its winding start portion and an inner surface of its winding end portion are overlapped with each other. A heater/presser heated by a heater is pressed against an overlapped portion. The overlapped portion is heated and bonded by thermoplastic resin applied to the tape, to bind the material to be bound.

In the binding machine, a tape delivered from a tape roll held in the machine so as to be rotatable is caused to travel along a guide path in an arch shape, to form a loop of the tape along the guide path. The loop is then tightened, to bind the material to be bound arranged in the loop.

Meanwhile, this type of binding machine is used to close a package made of synthetic resin or paper for covering a railroad box lunch or take-out food, for example, by winding a tape.

However, a person who will eat the railroad box lunch or the like can not, in some cases, satisfactorily fracture the tape wound around the railroad box lunch or the like.

Therefore, an enormous number of nicks are previously formed with very small spacing at a side edge of the material itself of the tape wound around the tape roll.

However, such a tape roll is higher in cost by approximately 30%, for example. Therefore, the binding cost is increased.

Such a problem is not limited to the binding of the railroad box lunch. For example, it similarly exists in all uses required for a user to fracture a binding tape.

SUMMARY OF THE INVENTION

An object of the present invention is to provide a binding machine with a tape, in which a user can easily fracture a binding tape, and the binding cost is low.

In order to attain the above-mentioned object, in a preferred mode of the present invention, a binding machine with a tape, which binds a material to be bound by enlarging a loop formed at an end of a tape delivered from a tape roll to a predetermined size by the travel of the tape to arrange the material to be bound inside the enlarged loop and tightening the tape to contract the loop, comprises a tape traveling mechanism that can cause the tape to travel in order to expand and contract the loop formed by the tape; a table on which the material to be bound can be put; a tape passage groove formed on the table; a guide frame provided above the tape passage groove for guiding the tape which travels; and nick formation means for forming a nick for inducing fracture at a side edge of the tape having the loop enlarged to the predetermined size.

In this mode, the nick is formed in the stage of the enlarged loop before tightening, and the tape is then tightened to contract the loop, thereby binding the material to be bound. It is possible to use as the tape in the tape roll a conventional one having no nick. Therefore, the binding cost can be made low through the reduction in the cost of the tape.

The nick may be in any shape, provided that it can induce the fracture of a tape by hand tearing. For example, a half-cut nick having a part of its thickness cut may be used in addition to a nick line, a V-cut nick, and a Y-cut nick.

DETAILED DESCRIPTION OF THE PREFERRED EMBODIMENT

A preferred embodiment of the present invention will be described while referring to the accompanying drawings.

Figure 1:
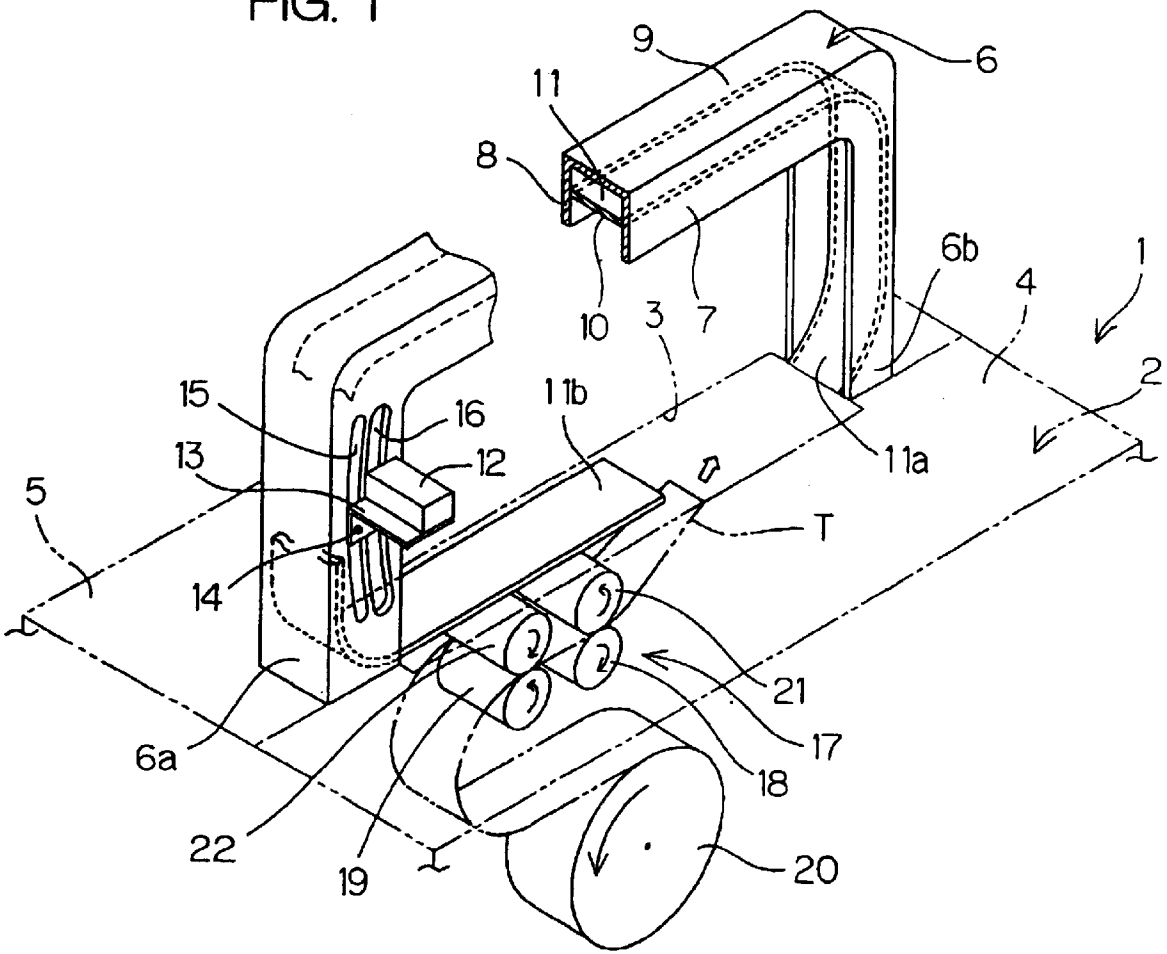
FIG. 1 is a partially broken perspective view showing a principal part of a binding machine with a tape according to an embodiment of the present invention.

FIG. 1 illustrates a principal part of a binding machine with a tape according to an embodiment of the present invention. Referring to FIG. 1, an upper surface of the main body of a binding machine 1 is formed by a table 2 for receiving a material to be bound. The table 2 is divided into a front table 4 and a rear table 5 with a groove 3 serving as a tape path interposed therebetween. Legs 6*a* and 6*b* of a guide frame 6 in an arch shape arranged above the table 2 are respectively fixed to both ends of the groove 3. The guide frame 6 has a ⊐ shape (a so-called groove shape) in cross section having a pair of flanges 7 and 8 and a web 9 connecting the flanges 7 and 8 to each other. A front sidewall and a rear sidewall of a guide path 10 are respectively composed of the pair of flanges 7 and 8.

Furthermore, a guiding member 11 composed of an arch-shaped plate, for example, for guiding an outer surface (a curved outer surface) of a tape T, having thermal adhesive properties, which travels in order to form a loop is arranged inside the guide frame 6. The guiding member 11 constitutes an outer peripheral wall of the guide path 10. The guiding member 11 extends to a tape discharge end 11*b* from a tape introduction end 11*a*.

Furthermore, a nick forming mechanism 12 serving as nick formation means for forming a nick in the tape T is attached to the front flange 7 in the one leg 6*a* of the guide frame 6 through a mounting bracket 13. The mounting bracket 13 can be fixed to the flange 7 by adjusting the position thereof up and down. Therefore, a mounting screw 14 penetrating the mounting bracket 13 is screwed into a nut (not shown) on a rear surface of the flange 7 through an insertion hole 15 composed of a slit in a circular arc shape extending up and down which is formed in the flange 7.

Reference numeral 16 denotes an insertion hole composed of a slit in a circular arc shape extending up and down which is formed in the flange 7 in order to introduce a part of a cutter 35, described later, of the nick forming mechanism 12 into the guide path 10.

Figure 2:
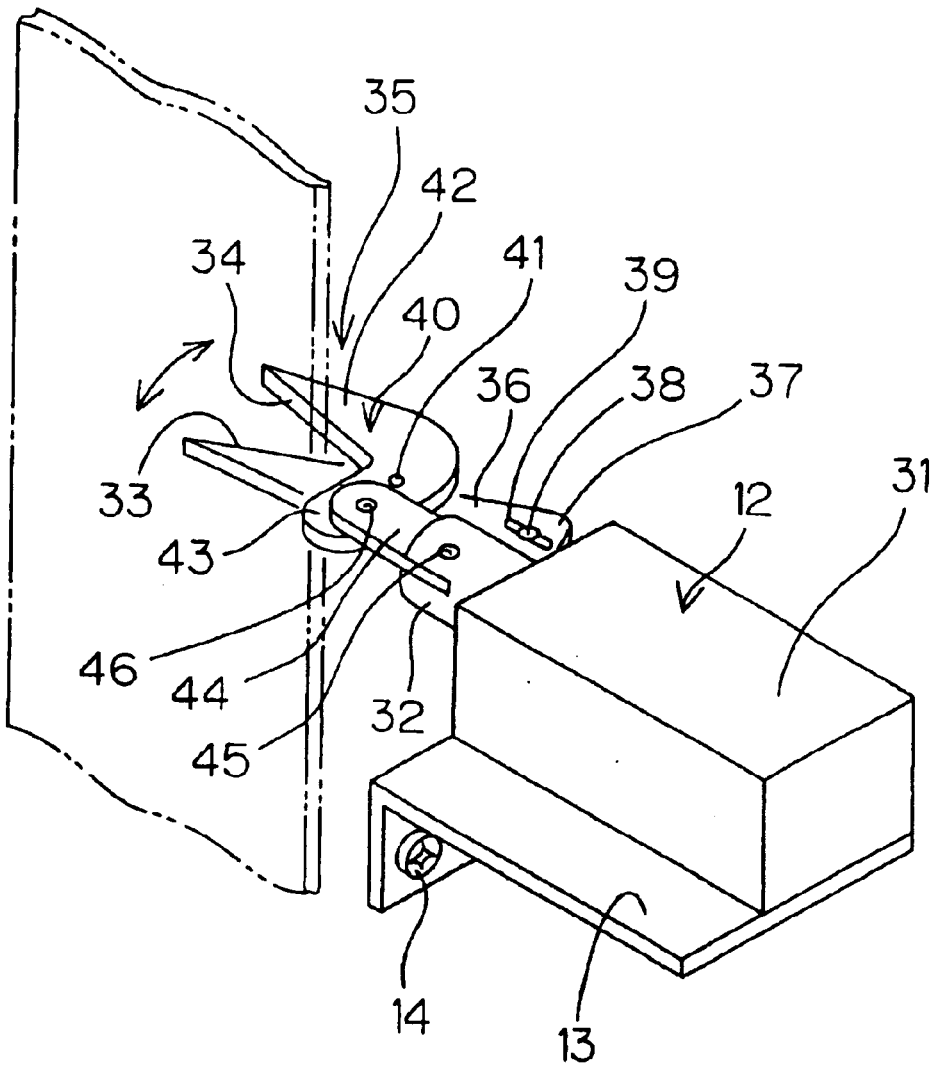
FIG. 2 is a schematic perspective view showing a nick forming mechanism.
Figure 3A:
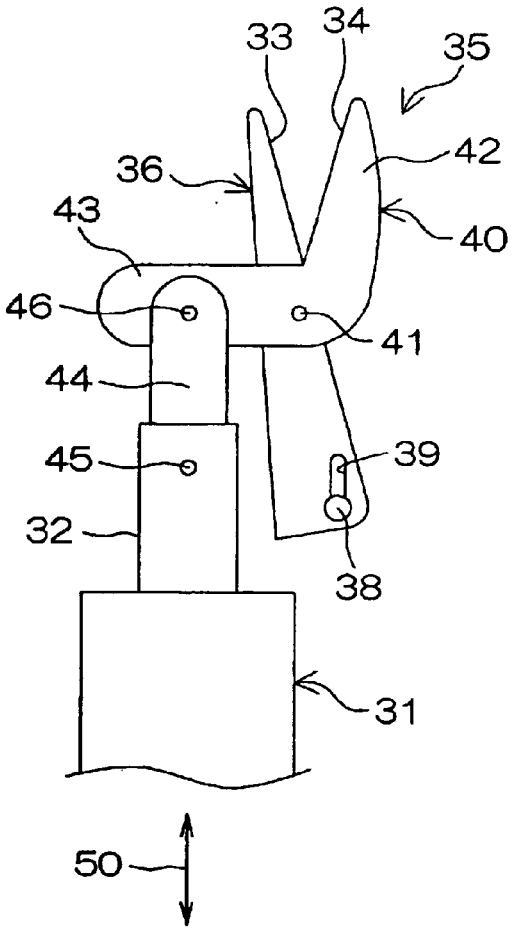
FIGS. 3A and 3B are schematic plan views each showing the operations of a nick forming mechanism.
Figure 3B:
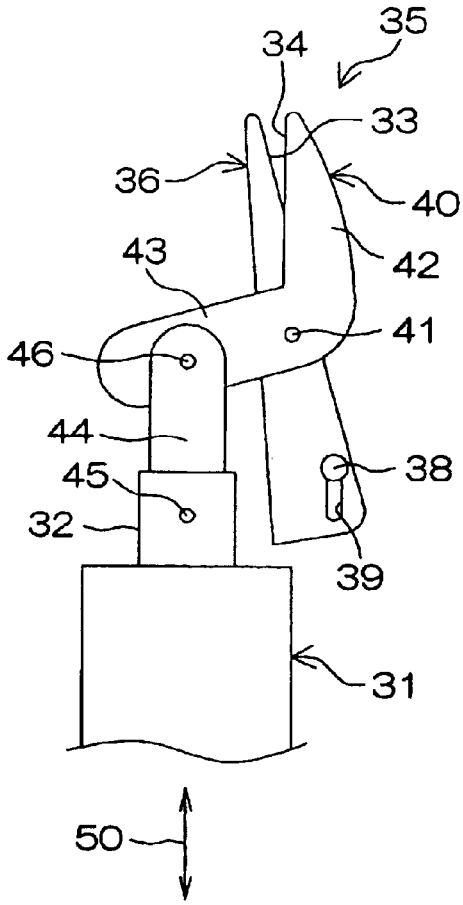

Referring to FIGS. 2, 3A and 3B, the nick forming mechanism 12 comprises a solenoid 31 serving as driving means containing a return spring and the cutter 35 for opening and closing first and second cutting edges 33 and 34 upon being driven by the advance and retreat of an operating bar 32 serving as a driver of the solenoid 31.

The first cutting edge 33 is formed in a longitudinal first member 36. The first member 36 is supported so as to be swingable around a supporting shaft 38 at its base end 37. A hole provided at the base end 37 of the first member 36 in order that the supporting shaft 38 should be inserted thereinto is formed into a slit 39. The slit 39 extends in a direction parallel to the direction of advance and retreat 50 of the operating bar 32. The base end 37 of the first member 36 can be moved so as to be slidable in the direction parallel to the direction of advance and retreat 50 of the operating bar 32 by the slit 39.

The second cutting edge 34 is formed in the second member 40. The first member 36 and the second member 40 are connected to each other so as to be slidable through a first connecting shaft 41.

The second member 40 forms the shape of an angle having a first piece 42 including the second cutting edge 34 and a second piece 43. The first connecting shaft 41 is provided in the vicinity of a portion where the first piece 42 and the second piece 43 cross each other.

A plate-shaped extender 44 is provided in the operating bar 32. A base end of the extender 44 is inserted into a connecting groove formed in the operating bar 32, and is connected to the operating bar 32 through a connecting pin 45. The first piece 42 of the second member 40 is connected to an end of the extender 44 in the operating bar 32 so as to be relatively rotatable through a second connecting shaft 46.

Figure 4A:
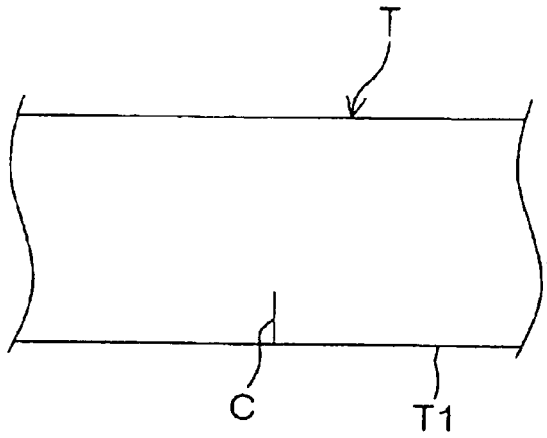
FIGS. 4A to 4C are plan views each showing a tape formed with a nick.
Figure 4B:
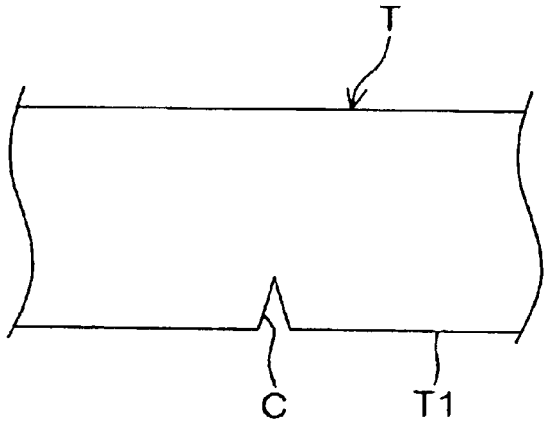
Figure 4C:
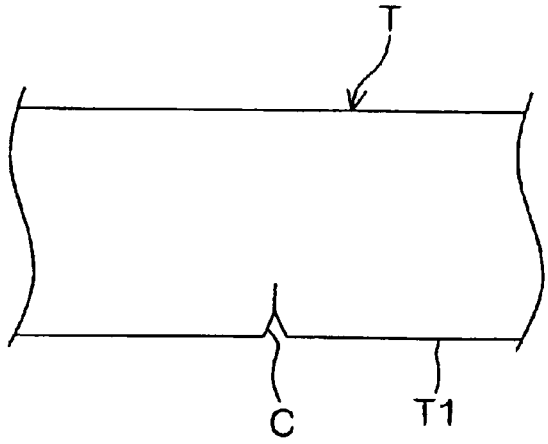

A spring, which is not illustrated, for urging the operating bar 32 in the direction of advance and retreat is contained in the solenoid 31. When a coil inside the solenoid 31 is excited, the operating bar 32 is shortened, as shown in FIG. 3B, against the spring, to close the first and second cutting edges 33 and 34, thereby performing an operation for cutting into the tape T. Consequently, a nick C as shown in FIG. 4A is formed at a side edge T1 of the tape T. The nick C is not limited to a linear nick as shown in FIG. 4A. For example, it can be a V-cut nick as shown in FIG. 4B and a Y-cut nick as shown in FIG. 4C.

Conversely, when the excitation of the coil inside the solenoid 31 is released, the operating bar 32 advances, as shown in FIG. 3A, by the force of the contained spring, so that the first and second cutting edges 33 and 34 are opened.

Referring to FIG. 1 again, a tape traveling mechanism 17 for delivering and pulling back the tape T is provided below the table 2. The tape traveling mechanism 17 has a delivery roller 18 and a binding roller 19 each composed of a rubber roller. The delivery roller 18 is driven so as to rotate forward (rotate in a clockwise direction), and is used in delivering the tape T in a tape roll 20 serving as a winding portion toward the introduction end 11*a* of the guiding member 11. Further, the binding roller 19 is driven so as to rotate in the opposite direction to the delivery roller 18 (rotate in a counterclockwise direction).

Driven rollers 21 and 22 each made of a metal are respectively arranged just above the delivery roller 18 and the binding roller 19. The driven rollers 21 and 22 are supported by a side plate of the main body of the binding machine 1 so as to be alternately abutted against the delivery roller 18 and the binding roller 19 which respectively correspond thereto. That is, when the tape T in the tape roll 20 is delivered, the delivery roller 18 and the driven roller 21 are abutted against each other (at this time, the driven roller 22 is spaced apart from the binding roller 19). When the tape T is bound upon being tightened around the material to be bound, the above-mentioned state is reversed, that is, the binding roller 19 and the driven roller 22 are abutted against each other, and the delivery roller 18 and the driven roller 21 separate from each other.

Referring to FIGS. 5A to 5F, a receiving plate 23, being movable back and forth, receiving a lower surface of the material to be bound A as well as holding an end of the tape T between the receiving plate and a first clamping member 24, a second clamping member 25 for holding an overlapped portion of the tape T between the second clamping member and a lower surface of the receiving plate 23, a heater/presser 26 for heating and pressing an overlapped portion of the tape T on the lower surface of the receiving plate 23, a cutter 27 for cutting the whole width of the tape T after heating and bonding, and so forth are arranged as a mechanism further provided in the binding machine. Further, there is provided a movable holding member 28 for holding the end of the tape T and reversing the end to form a small loop L by the tape T.

Referring now to FIGS. 5A to 5F, a binding operation will be described.

Figure 5A:
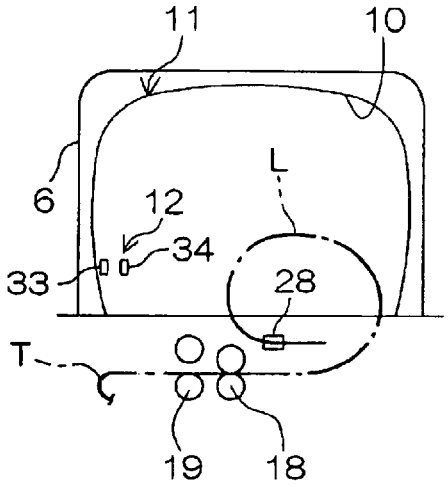
FIGS. 5A to 5E are schematic front views of a binding machine, each showing the steps of the binding process.

As shown in FIG. 5A, the movable holding member 28 that holds the end of the tape T is reversed, whereby the small loop L is formed at the end of the tape T.

Figure 5D:
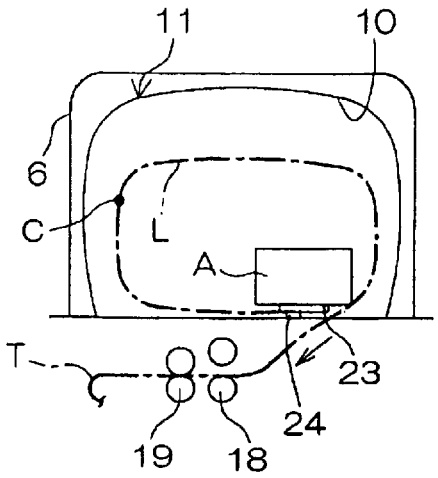
Figure 5B:
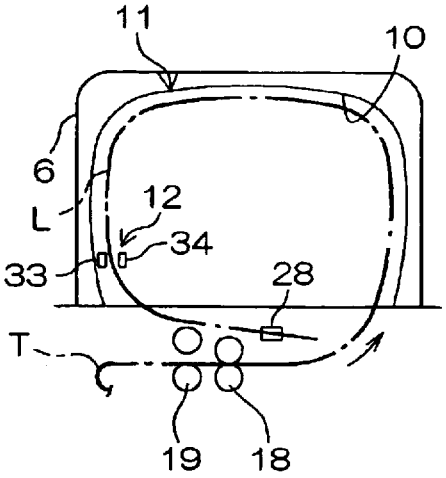

As shown in FIG. 5B, the tape T is then delivered by the delivery roller 18 and the driven roller 21, and is fed along the guide path 10 on the inner periphery of the guiding member 11, so that the loop L is expanded, to form the enlarged loop L. At this time, the first and second cutting edges 33 and 34 in the nick forming mechanism 12 are opened, so that the tape T inside the enlarged loop enters a region between the first and second cutting edges 33 and 34.

Figure 5E:
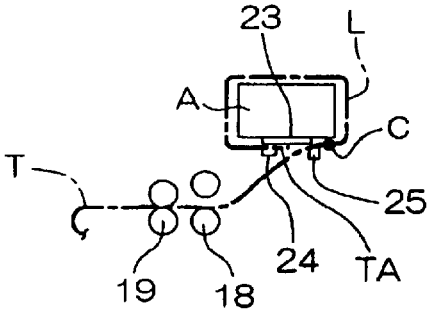
Figure 5C:
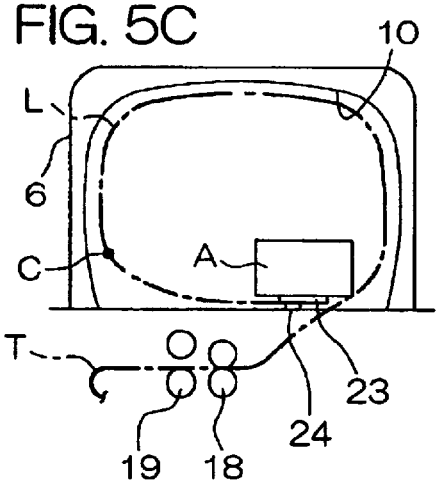

At the time point where the enlarged loop L is formed by the expansion, the end of the tape T is held between the lower surface of the receiving plate 23 and the first clamping member 24 which has advanced, and is stopped. In this state, the material to be bound A is put on an upper surface of the receiving plate 23 which has advanced into the groove, as shown in FIG. 5C. The solenoid 31 is turned on as the material to be bound A is put on the receiving plate 23, so that the nick C is formed in the tape T inside the enlarged loop L.

In order to detect that the material to be bound A is put on the receiving plate 23, sensing means such as an optical sensor may be provided in the passage groove 3, or a user may press a switch indicating that the putting is completed after the material to be bound A is put to start to form a nick in the tape T as the switch is pressed.

After the nick is formed in the tape T, the tape T is then pulled back by the binding roller 19, so that the loop diameter is reduced, as shown in FIG. 5D. When the loop diameter is further reduced, the tape T surrounds the material to be bound A in a dense state, as shown in FIG. 5E. In this state, the nick C is positioned on the lower surface of the material to be bound A. After the tape T surrounds the material to be bound A in a dense state, the end of the tape T and the winding end portion of the tape T are overlapped with each other, to be clamped between the lower surface of the receiving plate 23 and the second clamping member 25.

Figure 5F:
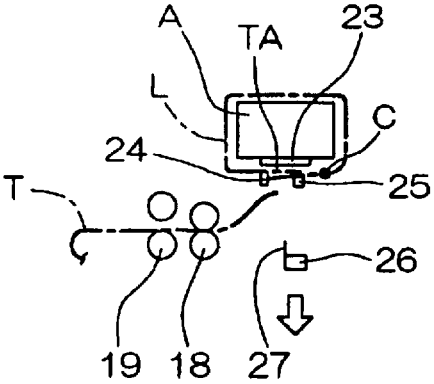

As shown in FIG. 5F, the heater/presser 26 with the cutter 27 then heats an overlapped portion Ta of the tape T while pressing the overlapped portion against the lower surface of the receiving plate 23 to heat and bond the overlapped portion, and the cutter 27 cuts the tape T. Thereafter, the receiving plate 23 retreats, thereby completing the binding. Further, the solenoid 31 is turned off, so that the first and second cutting edges 33 and 34 are opened, to enter a state where the subsequent binding process is prepared.

According to the present embodiment described above, the nick C is formed in the stage of the enlarged loop L before tightening, and the nick C is tightened, to bind the material to be bound. It is possible to use as the tape in the tape roll 20 a conventional one having no nick. Accordingly, the binding cost can be made low through the reduction of the cost of the tape.

Furthermore, the position of the nick forming mechanism 12 can be adjusted, thereby making it possible to easily adjust the position, where the nick is formed, in the enlarged loop L depending on the size of the material to be bound A. Accordingly, the range of an object to be bound is enlarged to enhance versatility.

The nick C may be one in any shape, provided that it can induce the fracture of the tape by hand tearing. For example, it may be a half-cut nick having a part of its thickness cut in addition to the nick line, the V-cut nick and the Y-cut nick, as described above.

Figure 6:
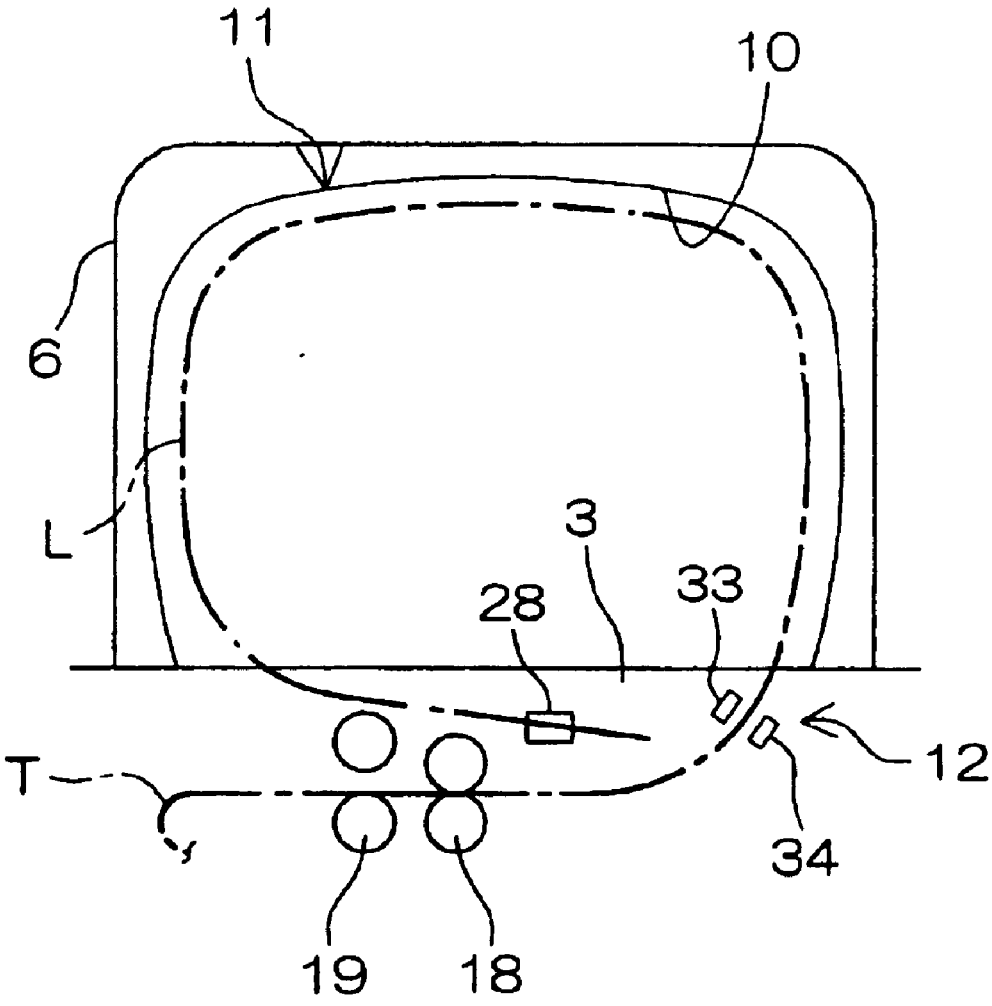
FIG. 6 is a schematic view showing the layout of a nick forming mechanism according to another embodiment of the present invention.

Although in the above-mentioned embodiment, the nick forming mechanism 12 is arranged in the guide frame 6, the nick forming mechanism 12 can be also arranged in the tape passage groove 3, as shown in FIG. 6.

While the invention has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A binding machine with a tape, which binds a material to be bound by enlarging a loop formed at an end of a tape delivered from a tape roll to a predetermined size by the travel of the tape to arrange the material to be bound inside the enlarged loop and tightening the tape to contract the loop, comprising:

a tape traveling mechanism that can cause the tape to travel in order to enlarge and contract the loop formed by the tape;

a table on which the material to be bound can be mounted;

a tape passage groove formed on the table;

a guide frame provided above the tape passage groove for guiding the tape which travels; and nick formation means provided in the guide frame, and being for forming a nick for inducing fracture at a side edge of the tape having the loop enlarged to the predetermined size, wherein the guide frame forms the shape of a groove having a web and a pair of flanges, and the nick formation means is attached to either one of the flanges in the guide frame.

2. A binding machine with a tape, which binds a material to be bound by enlarging a loop formed at an end of a tape delivered from a tape roll to a predetermined size by the travel of the tape to arrange the material to be bound inside the enlarged loop and tightening the tape to contract the loop, comprising;

a tape traveling mechanism that can cause the tape to travel in order to enlarge and contract the loop formed by the tape;

a table on which the material to be bound can be mounted;

a tape passage groove formed on the table;

a guide frame provided above the tape passage groove for guiding the tape which travels;

nick formation means provided in the guide frame, and being attached to the guide frame in the direction of the travel of the tape such that the position thereof is adjustable, and being for forming a nick for inducing fracture at a side edge of the tape having the loop enlarged to the predetermined size; and fixing means for fixing the nick formation means to either one of the flanges so as to be releasable, the fixing means comprising a screw which is inserted into an insertion hole composed of a slit formed in either one of the flanges.

3. A binding machine with a tape, which binds a material to be bound by enlarging a loop formed at an end of a tape delivered from a tape roll to a predetermined size by the travel of the tape to arrange the material to be bound inside the enlarged loop and tightening the tape to contract the loop, comprising:

a tape traveling mechanism that can cause the tape to travel in order to enlarge and contract the loop formed by the tape;

a table on which the material to be bound can be mounted;

a tape passage groove formed on the table;

a guide frame provided above the tape passage groove for guiding the tape which travels; and nick formation means provided in the guide frame, and being attached to the guide frame in the direction of the travel of the tape such that the position thereof is adjustable, and being for forming a nick for inducing fracture at a side edge of the tape having the loop enlarged to the predetermined size, wherein either one of the flanges has an insertion hole composed of a slit through which at least a part of the nick formation means is to be inserted into the guide frame.

4. A binding machine with a tape, which binds a material to be bound by enlarging a loop formed at an end of a tape delivered from a tape roll to a predetermined size by the travel of the tape to arrange the material to be bound inside the enlarged loop and tightening the tape to contract the loop, comprising:

a tape traveling mechanism that can cause the tape to travel in order to enlarge and contract the loop formed by the tape;

a table on which the material to be bound can be mounted;

a tape passage groove formed on the table;

a guide frame provided above the tape passage groove for guiding the tape which travels; and nick formation means for forming a nick for inducing fracture at a side edge of the tape having the loop enlarged to the predetermined size, wherein the nick formation means is arranged in the tape passage groove.

5. A binding machine with a tape, which binds a material to be bound by enlarging a loop formed at an end of a tape delivered from a tape roll to a predetermined size by the travel of the tape to arrange the material to be bound inside the enlarged loop and tightening the tape to contract the loop, comprising:

a tape traveling mechanism that can cause the tape to travel in order to enlarge and contract the loop formed by the tape;

a table on which the material to be bound can be mounted;

a tape passage groove formed on the table;

a guide frame provided above the tape passage groove for guiding the tape which travels; and nick formation means for forming a nick for inducing fracture at a side edge of the tape having the loop enlarged to the predetermined size, wherein the nick formation means comprises a cutter driven by driving means, the driving means includes a driver which can advance and retreat in predetermined directions respectively, and the cutter comprises first and second cutting edges which are opened and closed depending on the advance and retreat of the driver in the driving means in the predetermined directions.

6. The binding machine with a tape according to claim 5, wherein the first cutting edge is provided in a first member, and the second cutting edge is provided in a second member, the first and second members are connected to each other through a first connecting shaft, and the first and second members are relatively rotatable around the first connecting shaft, and the second member is connected to the driver through a second connecting shaft spaced apart from the first connecting shaft, and the second member and the driver are relatively rotatable around the second connecting shaft.

7. The binding machine with a tape according to claim 6, wherein the second connecting shaft connects an extender provided in the driver and the second member to each other so as to be relatively rotatable.

8. The binding machine with a tape according to claim 6, wherein the first member is supported so as to be movable in a direction parallel to the predetermined directions by a supporting shaft spaced apart from the first connecting shaft, and the first member is swingable around the supporting shaft.

9. The binding machine with a tape according to claim 5, wherein the driving means comprises a solenoid, and the driver comprises an operating bar of the solenoid.

* * * * *